US005162605A

United States Patent [19]

Piesik

[11] Patent Number: 5,162,605

[45] Date of Patent: Nov. 10, 1992

[54] SELF-ACTIVATED ROCKET LAUNCHER CELL CLOSURE

[75] Inventor: Edward T. Piesik, Pomona, Calif.

[73] Assignee: General Dynamics Corporation, Pomona, Calif.

[21] Appl. No.: 821,159

[22] Filed: Jan. 16, 1992

[51] Int. Cl.[5] ..... F41F 3/04

[52] U.S. Cl. ..... 89/1.817; 89/1.816; 89/1.812

[58] Field of Search ..... 89/1.817, 1.816, 1.812, 89/1.8

[56] References Cited

U.S. PATENT DOCUMENTS

| | | | |
|---|---|---|---|
| 1,102,228 | 7/1914 | Balfour | 49/21 |
| 1,464,764 | 8/1923 | Jensen | 49/21 |
| 2,138,427 | 11/1938 | Payden | 49/890.5 |
| 2,141,923 | 12/1938 | McMahan | 49/742 |
| 3,052,303 | 9/1962 | Lapp | 89/1.812 |
| 3,087,386 | 4/1963 | Rung et al. | 89/1.810 |
| 3,088,374 | 5/1963 | Guyant et al. | 89/1.817 |
| 3,158,062 | 11/1964 | Feiler | 89/1.817 |
| 3,362,291 | 1/1968 | De Luca | 89/1.817 |
| 4,044,648 | 8/1977 | Piesik | 89/1.812 |
| 4,134,327 | 1/1979 | Piesik | 89/1.816 |
| 4,173,919 | 11/1979 | Piesik | 89/1.816 |
| 4,186,647 | 2/1980 | Piesik | 89/1.816 |
| 4,324,167 | 4/1982 | Piesik | 89/1.812 |
| 4,373,420 | 2/1983 | Piesik | 89/1.812 |
| 4,683,798 | 8/1987 | Piesik | 89/1.812 |
| 4,686,884 | 8/1987 | Piesik | 89/1.816 |
| 4,756,226 | 7/1988 | Piesik | 89/1.8 |
| 4,796,510 | 1/1989 | Piesik | 89/1.816 |
| 4,934,241 | 6/1990 | Piesik | 89/1.817 |

*Primary Examiner*—David H. Brown

*Attorney, Agent, or Firm*—Leo R. Carroll; Henry Bissell

[57] ABSTRACT

A structural arrangement is provided in conjunction with the upper closure of a missile cell which, upon launch of the missile, generates a rarefaction wave which assists in closing the bottom closure of the missile cell. As a result, reverse flow of exhaust gases back up into the missile chamber from an associated plenum chamber is prevented or minimized.

9 Claims, 2 Drawing Sheets

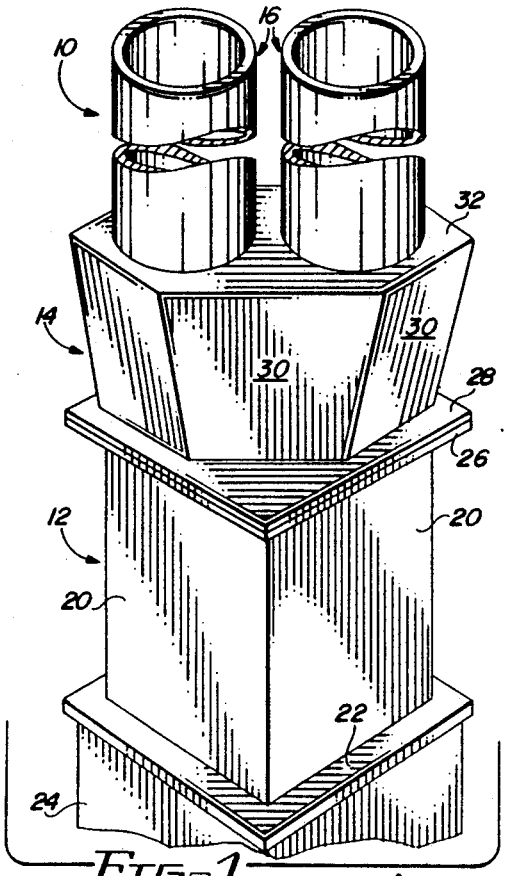
FIG. 1
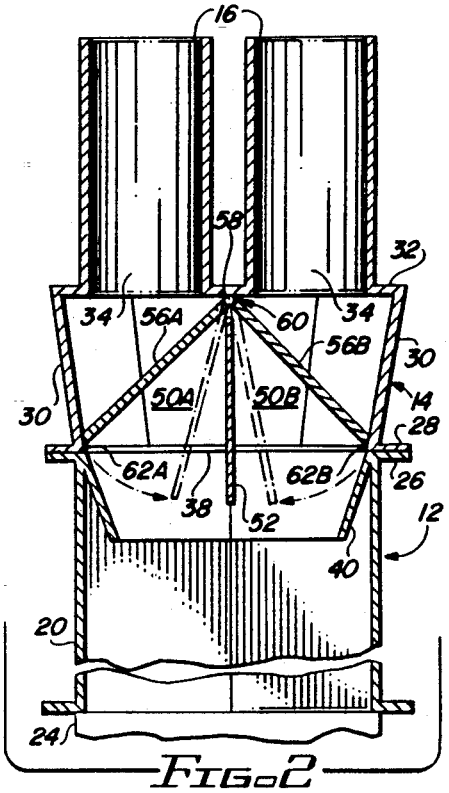
FIG. 2
FIG. 3
(PRIOR ART)
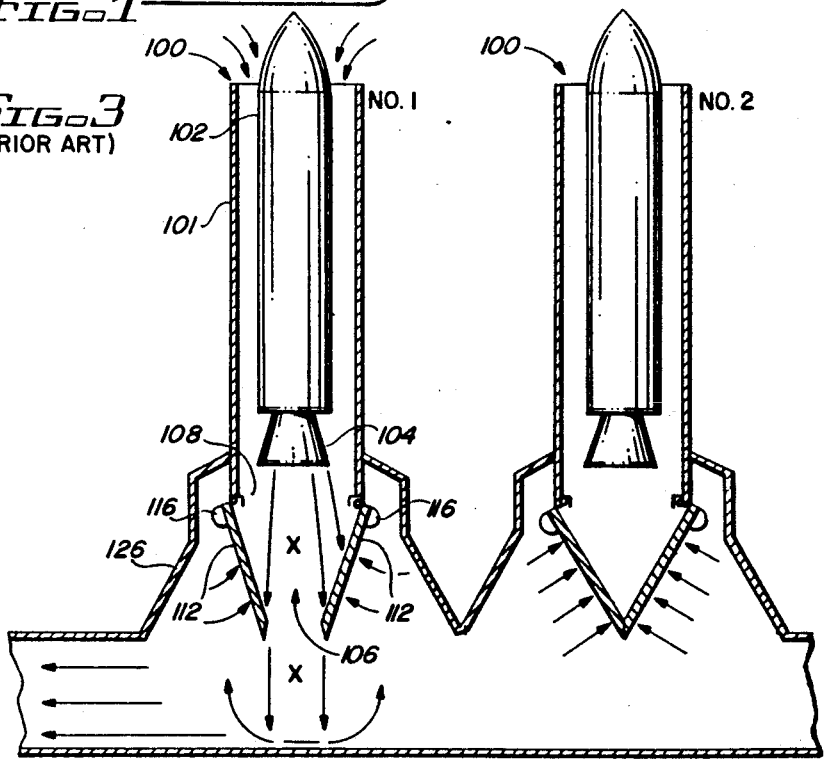

SELF-ACTIVATED ROCKET LAUNCHER CELL CLOSURE

BACKGROUND OF THE INVENTION

1. Field of the Invention.

The present invention relates to the field of controlled flow, exhaust manifold systems and, more particularly, to apparatus for limiting the reverse flow of missile exhaust gases by closing off the cell of the fired missile from a common exhaust gas manifold or plenum tube connected thereto.

2. Description of the Related Art.

In certain military applications, particularly on warships having missile firing capability, the missiles are stored in a series of vertically oriented chambers or cells closely adjacent one another. Exhaust gas outlets are normally provided to duct rocket exhaust gases generated during intended or accidental rocket ignitions to a safe location. In such installations, manifolding of a number of chambers into a common exhaust duct or plenum tube has become conventional.

There have been a number of approaches to the problems attendant upon the use of a common exhaust duct with a plurality of missile storage chambers. It is important to be able to block the exhaust gases from a missile which is being fired from blowing out through the individual chambers of other missiles This is commonly accomplished by the use of doors or hinged panels which can open into the plenum chamber from the force of an impinging missile exhaust for the chamber containing the missile being fired and which can close off the passage at the base of a missile chamber opening into the exhaust plenum for other missiles. Eastman U.S. Pat. No. 2,445,423 discloses apparatus having a plurality of individual missile chambers coupled to a common plenum chamber with a plurality of hinged, spring-loaded doors at the juncture of each individual missile chamber with the plenum tube. These doors open for a rocket that is being fired and serve to confine the exhaust gases within the plenum chamber and away from other missile-storage chambers.

There is also the problem of a portion of the rocket exhaust backing up into the chamber of the missile being fired and possibly over-pressurizing that missile chamber.

My own prior U.S. Pat. No. 4,044,648, the entire disclosure of which is incorporated by reference as though fully set forth herein, discloses a pair of hinged doors at the base of each missile storage chamber in the passage connecting the chamber to an associated exhaust plenum duct. The pressure forces on opposite sides of the doors during the firing of a missile are balanced to control the degree to which the doors are opened in order to adjust the opening to the varying dimension of the rocket exhaust stream as the missile rises and leaves the chamber upon firing. As a consequence, the rocket exhaust stream functions as a suitable "gas plug" in the opening in order to prevent recirculation of the exhaust gases back into the chamber undergoing firing.

It is important to control the rocket exhaust gas stream so that the gas plug is effective to prevent recirculation of exhaust gases back into the chamber. Control of the rocket exhaust stream on a dynamic basis to develop the gas plug effect appears to be more effective for the intended purpose than the use of fixed structure such as baffles, valves, diverters or the like which oftentimes have the undesirable result of interfering with the direct exhaust gas stream in their attempt to control flow, limit reverse circulation, etc. My prior U.S. Pat. No. 4,683,798, the entire disclosure of which is incorporated by reference as though fully set forth herein, discloses hinged doors near the lower end of each missile storage chamber but spaced from the juncture with the common plenum chamber by a transition region which provides a smooth transition from a generally square cross-section chamber in which a missile is stored and launched to a round exit opening in the chamber which connects with the exhaust plenum. This enhances the gas plug effect and uses it to prevent recirculation of exhaust gases back into the chamber of the missile being fired.

My prior U.S. Pat. No. 4,686,884, the entire disclosure of which is incorporated by reference as though fully set forth herein, discloses an arrangement including sets of doors to close off missile storage chambers coupled to a common plenum chamber upon the firing of a missile in another chamber with the addition of pivotable deflector panels which are installed in transition sections between the missile storage and launch chambers proper and the common plenum chamber.

My prior U.S. Pat. No. 4,934,241, the entire disclosure of which is incorporated by reference as though fully set forth herein, discloses an arrangement, principally for shipboard use, wherein an uptake channel is provided to direct exhaust gases upward between a pair of adjacent missile cells. The arrangement includes a missile cell cover which is arranged to open for the missile being fired and to close automatically after the missile clears the storage chamber, thus preventing additional rocket exhaust from being channelled into the plenum at the base of the chamber. The cover is designed to open, when released from the latched closed position, to an open position in which it serves to divert uptake exhaust flow away from the missile as it exits the storage chamber. After the missile clears the canister and the rocket exhaust begins to impinge on the hatch cover, the hatch cover is unlocked from its open position by actuation of a drag flap that is deployed to help close the hatch cover.

My following listed prior patents deal with related aspects of rocket exhaust plenum chambers coupled to a plurality of missile launch canisters and the principles of using rocket exhaust gas flow to close the after doors of missile canisters not presently undergoing launch firing or maintaining such doors closed during the firing of a missile in another canister: U.S. Pat. Nos. 4,134,327, 4,173,919, 4,186,647, 4,324,167, and 4,373,420.

SUMMARY OF THE INVENTION

In brief, arrangements in accordance with the present invention comprise aft closing arrangements for multi-missile launch systems incorporating a plurality of launch cells exhausting into a common plenum. The construction of systems in which embodiments of the invention are installed is such that the minimum flow area for exhaust gases resides in the canister or cell from which the fired missile is being launched, rather than in the transition flow passages leading to the common exhaust plenum. This flow area is such that, during the missile traversal of the launch canister, the supersonic rocket exhaust flow cannot negotiate the minimum flow area without "choking". "Choking" occurs when the product of the flow density and velocity is less than the mass flow rate per unit flow area, as described by the Continuity Equation At the onset of "choke" conditions, the velocity at the minimum flow area has a Mach number which is just equal to 1.0. For some distance upstream, the flow is subsonic with the recovery pressure more than twice the pressure downstream of the minimum flow area.

Such multi-missile launch cells involve rocket exhaust flow that expands to fill the designed channel area downstream of the rocket nozzle exit, even when opposed by the pressure which exists at or beyond the channel exit. Such systems thus prevent any back flow or recirculation of exhaust flow into the volume which is upstream of the rocket nozzle exit. The area downstream of the rocket nozzle is equal to or greater than the nozzle exit and is constant or increasing in size as a function of distance downstream from the nozzle. Arrangements in accordance with the present invention are specifically designed to protect multi-missile canisters and the missiles therein during any normal or restrained missile firing in a Vertical Launcher System (VLS).

Particular embodiments of the present invention comprise missile launch cells or canisters having additional closures or covers at or near the top hatch of the cell, such as a hinged cover somewhat like the canister hatch cover arrangement disclosed in my U.S. Pat. No. 4,934,241. However, in the present arrangement, the cover is not biased, when unlatched, to a position beyond the vertical nor is it designed to deflect upwardly flowing exhaust gases from the missile being fired.

Arrangements in accordance with the present invention incorporate one or more transverse protuberances projecting inwardly from the launcher cell cover. These protuberances are fixedly attached or otherwise mounted on the inside of the cell closure and have a shape which provides for clearance of the missile as it exits the launcher cell.

The purpose of the structural configuration of the inventive embodiment is to insure that the cover closes after the missile exits the launcher. As the missile clears the launcher, rocket exhaust expands beyond the diameter of the missile and impinges on the protuberances fixed on the inside of the cell closure. The pressure on the protuberance area produces a closing moment and the closure rotates into the exhaust flow. This condition further accelerates the closing motion of the closure because of the increasing exhaust pressure on larger and larger areas of the upper side of the closure as the closure rotates toward the closed position. The protuberances are designed to clear the inner geometry of the missile launch cell during the closure motion and do not interfere with the missile geometry during the launch sequence. This arrangement for quickly and effectively closing the missile cell closure or cover accomplishes the purpose without dependence on any moving parts. Interference or contact with the missile as it leaves the cell is avoided by virtue of the geometric shape design.

I have discovered that the operation of the closure in the manner described develops an effect which enhances the closure of the lower end doors between the launching cell and the plenum chamber. With the sudden closing of the cell cover, a rarefaction wave is produced which results in reduced pressure within the cell. The wave moves from the closure location toward the plenum at the exhaust end of the launch cell. This transient wave of reduced pressure tends to cause the plenum end cell door or doors to close, since the plenum pressure is greater than the launcher cell pressure during the period of rarefaction (assuming the rear closure configuration is similar to that which is disclosed in my U.S. Pat. No. 4,044,648 or in other similar configurations). Thus an improved and more effective closure arrangement is provided for missile launch systems to which the present invention is adaptable.

BRIEF DESCRIPTION OF THE DRAWINGS

A better understanding of the present invention may be realized from a consideration of the following detailed description, taken in conjunction with the accompanying drawings in which:

FIG. 1 is a perspective view of a multi-missile canister system of my prior invention;

FIG. 2 is a sectional elevation of the system of FIG. 1;

FIG. 3 is a schematic view of a prior art system, showing a pair of missile cells coupled to a common exhaust plenum;

DESCRIPTION OF THE PREFERRED EMBODIMENTS

Figure 5:
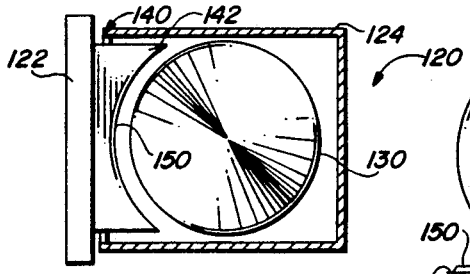
FIG. 5 is a schematic top plan view of the arrangement of FIG. 4.

One embodiment of my prior invention comprising a dual missile canister gas management system to which arrangements in accordance with the present invention may be adapted is depicted in FIGS. 1 and 2. This embodiment 10 principally comprises a lower transition section 12, an upper transition section 14 and a pair of missile canisters or cells 16 which sit atop the section 14. The section 12 is generally square (or rectangular) in cross section with adjacent sidewalls 20 joined at right angles and provided with a bottom flange 22 which serves to couple the system to an associated plenum chamber 24.

The lower transition section 12 terminates in an upper flange 26 which is joined to a plate 28 to which the upper transition portion is attached. Vertically angled sidewalls 30 extend upwardly from the plate 28 to a second plate 32, to which the missile canisters 16 are attached. Adjacent sidewalls 30 are joined together, forming a six-sided configuration of the upper transition section 14. The upper plate 32 is provided with a pair of circular openings 34 to connect the interior volumes of the two missile canisters 16 with the upper transition portion 14. The plate 28 is provided with an opening 38 shaped to match the lower cross-sectional outline of the transition section 14 which serves to connect the interior spaces of the two transition portions 12 and 14. A tapered skirt 40 projects downwardly into the upper portion of the lower transition section 12, substantially continuing the angle with the vertical which is made by the walls 30 of the upper transition section 14.

The upper transition portion 14 is divided into two compartments 50A and 50B by a transverse vertical plate 52 which extends across the interior of the transition section 14 between opposed sidewalls 30 in a plane which is orthogonal to a plane defined by the two longitudinal axes of the missile canister 16 (the plane of the paper in FIG. 2). This transverse vertical plate 52 extends from near the top of the upper transition section 14 into the space encompassed by the skirt 40.

In each of the spaces 50A, 50B there is a hinged door, 56A or 56B. These two doors 56A, 56B are hinged to swing about a pivot point 58 by hinge mechanism 60. The doors 56A, 56B are shown in solid outline form in FIG. 2 in the closed position, wherein the terminal edge of a door, 62A or 62B, abuts against the lower edge of adjacent walls 30 of the upper transition section 14. The doors 56A and 56B are shown in broken outline form in FIG. 2 as they transition from the fully closed position to the fully open position in which they rest flat against the vertical plate 52. It will be noted that the plate 52 extends to the lower edge of the doors 50A, 50B when the doors are in the fully open position. When in the closed position, the doors 50A, 50B completely block off the transfer of any exhaust gases upward into the missile cylinders 16 from the exhaust plenum. In the operation of the system 10, these doors open one at a time to permit exhaust gases from a missile being fired in one of the missile cylinders 16 to flow downwardly into the exhaust plenum 24 through the transition sections 12, 14 while limiting or preventing any reverse flow or recirculation back into the cell 16.

FIG. 3 is a schematic view of a pair of individual launch stations 100 as disclosed in my prior U.S. Pat. No. 4,044,648. The launch stations 100 are shown containing a missile 102 having a rocket motor 104 which, for the No. 1 station, is indicated as ignited for launch and producing an exhaust 106. Each station 100 comprises a chamber 101 in which the missile 102 is stored and from which it is launched. At the bottom of the chamber 101 an outlet opening 108 permits the exhaust gases 106 to flow into a transition section 126, from which the exhaust gases 106 are diffused and directed into a plenum chamber 110 which is connected in common to all of the missile chambers. A pair of hinged doors 112 open or close in response to the forces generated by the exhaust gases, the arrows in the respective stations indicating the direction of flow of the exhaust gases and the direction of forces applied to the doors. In station No. 2 where the missile is not being fired, the forces from the exhaust gases in the plenum chamber maintain these doors tightly closed, increasing the biasing forces of the springs 116. In station No. 1, the exhaust gases from the rocket motor 104 force the doors 112 open to the extent necessary to permit the exhaust gases 106 to flow into the plenum chamber 110.

Figure 4:
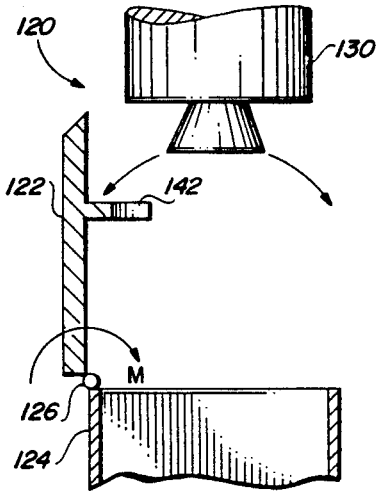
FIG. 4 is a schematic sectional elevation of an arrangement in accordance with the present invention for use in systems such as those depicted in FIGS. 1–3.

FIGS. 4 and 5 illustrate one particular arrangement in accordance with the present invention having a structural configuration which is adapted for installation on prior systems such as those depicted in FIGS. 1–3. The arrangement 120 is shown comprising a top cell closure or lid 122 installed on a missile chamber or cell 124 by means of a pivoting member such as a hinge 126. In FIG. 5, the cell 124 is shown with a missile 130 contained therein. In FIG. 4, the missile 130 is shown undergoing launch from the cell 124.

The closure 122 has a protuberance 140 in the form of a protruding ledge 142 which is rigidly mounted to the inner side of the hinged closure 122 at an angle of approximately 90 degrees. It will be seen in FIG. 5 that this ledge 142 is shaped with a generally semi-circular cutout 150 in order to accommodate the geometric structure of the missile as it flies out during launch. During storage, the top of the cell is far enough above the missile 130 that there is ample clearance for the projection 140.

Figure 6:
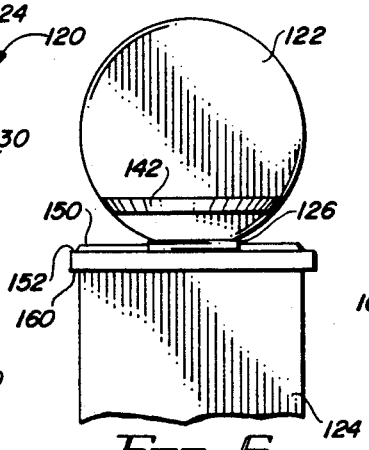
FIG. 6 is a schematic front elevation corresponding to the arrangement shown in FIGS. 4 and 5.
Figure 7:
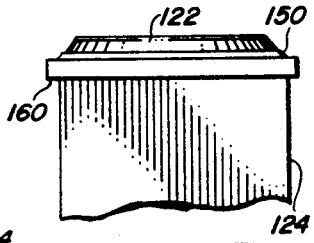
FIG. 7 is a view like FIG. 6 shown with the cover closed.

FIGS. 6 and 7 are schematic front elevational views corresponding to the side elevation of FIG. 4. In FIG. 6, the closure 122 is shown as a circular lid, hinged at 126 and having the protuberance 142 in the position shown. The closure 122 need not be circular, however, but may be square or rectangular as appropriate to match the surface against which it seals when in the closed position. A sealing member 150 is provided for this purpose, mounted on the upper surface 152 at the top of the cell 124 as indicated in FIGS. 6 and 7. A collar 160 is provided at the upper end of the cell 124 for reinforcement against the shock generated when the closure 122 slams shut. The sealing member 150 is resilient and cooperates with the collar 160 to provide the desired shock absorbing capability.

Figure 8:
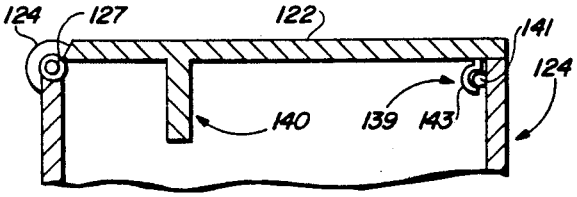
FIG. 8 is a schematic side elevation, in section, showing particular structural elements of the arrangement of FIGS. 4–7.

FIG. 8 shows the upper portion of the cell 124 with the lid 122 and attached protuberance 140 in closed position atop the cell 124. In close justaposition to the hinge 126 is a spiral spring 137 which serves to bias the cover 122 to the fully open position, as shown in FIG. 4, when it is released from its retainer. The retainer comprises a latch mechanism 139 having a catch 141 mounted to the inner wall of the cell 124 and a spring latch member 143 which slips over the catch 141 during movement of the cover 122 to or away from the closed position.

When the rocket motor of a missile within the cell 124 is ignited for launch, pressure builds within the cell 124 until the latch 139 releases the cover 122 so that it may be rotated to the fully open position. Alternatively, the cover may be opened prior to rocket ignition by remote command. Upon release of the cover from the latch 139, the biasing mechanism 137 associated with the hinge 126 urges cover 122 to that position indicated in FIG. 4.

Figure 9A:
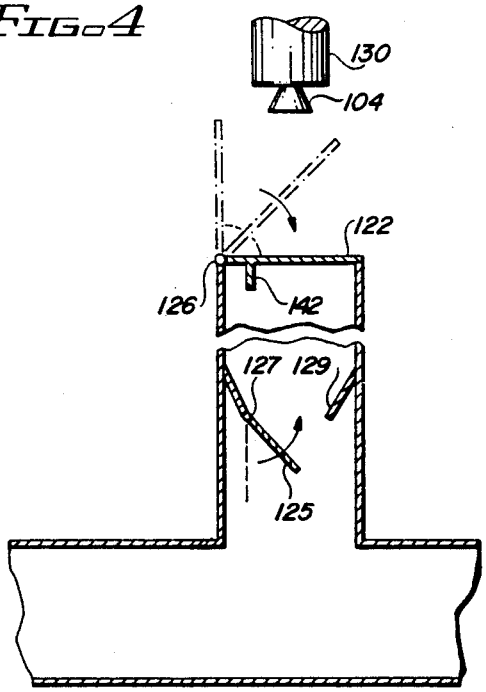
FIG. 9A is a schematic view showing the action of a missile being launched from a system incorporating the present invention.
Figure 9B:
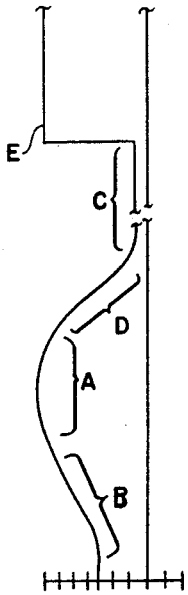
FIG. 9B is a graphical representation of instantaneous pressures at points within the arrangement of FIG. 9A, illustrating the principles of operation of the present invention.

FIG. 9A shows the operation of a system incorporating the present invention during the missile launching. The accompanying FIG. 9B is drawn to show the pressure wave in the launch cell 124 at the instant of closure of the lid 122. In FIG. 9A, the cell 124 is indicated as having a lower closure member 125 pivoted by a hinge member 127 from a transition ring 129. The broken lines indicate phantom positions of the top and bottom closure members 122, 125.

As the missile 130 is being launched from the cell 124, pressure from the rocket motor 104 builds up within the cell 124 and extends into the plenum chamber 110 as the exhaust gases flow from the cell 124 through the transition ring 129 into the plenum. As indicated in FIG. 4, as the missile 130 clears the launch cell 124, the rocket exhaust expands beyond the diameter of the missile and impinges on the protuberance 142 mounted on the inside of the cell closure 122. This protuberance or shelf 142 may be rigidly mounted to the closure 122 or it may be formed as an integral part thereof in the shape and angle indicated. Pressure on the upper surface of the shelf 142 produces a closing moment which initiates rotation of the lid 122 toward closure, moving it into the exhaust flow. This condition further accelerates the closing motion of the lid 122 because of the increasing force from the exhaust pressure on larger and larger areas of the closure 122.

With the sudden closing of the cell closure 122 as indicated in FIG. 9A, a rarefaction wave is produced, resulting from the momentum of the exhaust gases and the abrupt disruption of flow. This is indicated in the waveform of FIG. 9B, where the pressure near the exit portion of the cell 124 is, in the range designated A, at or near the full exhaust pressure, tailing off into the plenum 110 in the region designated B. For the given instant in time represented in FIG. 9B, immediately after the closure 122 is driven shut, the rarefaction wave extends along the length of the chamber 124, in the region designated C. At the position of the bottom closure 125, at the region designated D, the pressure on the outside of the bottom closure 125 greatly exceeds the pressure inside the chamber 124. This accelerates the closing of the bottom closure 125 and seals the bottom closure against the ring 129, maintaining the differential pressure across the door 125 for some period of time, thereby effectively preventing reverse gas flow from the plenum 110 into this cell 124, from which it might otherwise exhaust out the top. This closing is accelerated by the rarefaction wave inside the chamber 124 over the speed of closing that would normally be encountered without the top closure arrangement in accordance with the present invention. Thus the closing of the bottom closure 125 in this manner blocks flow of exhaust gases in the reverse direction back up into the chamber 124 from the plenum chamber 110, thereby avoiding the deleterious effects which might otherwise result therefrom.

The pressure at the outside of the closure 122 is equal to the rocket exhaust pressure. Thus there is a step function in pressure as indicated at the region designated E in FIG. 9B.

Although there have been described hereinabove various specific arrangements of self-actuating rocket chamber closures for multi-missile launch cells in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A missile canister closing system comprising:

a missile cell for containing a missile and launching a missile out the top thereof, said cell having a lower region connected via a passageway with an associated exhaust plenum chamber for transferring exhaust gases from the cell into the chamber and an upper region for releasing a missile during launch;

means defining a bottom closure in the lower region of said cell for closing off said passageway to block the reverse flow of exhaust gases from the plenum chamber into the cell;

means defining a top closure in the form of a cover mounted adjacent the upper region for covering the missile cell at the top thereof;

means pivotably connecting said top closure to the top of the missile cell for permitting the top closure to rotate between a fully open position which is clear from interference with the path of a missile being launched from said cell and a fully closed position in which the cover blocks gas flow through the top opening into the cell; and a fixed protuberance extending from the underside of said cover and rigidly attached thereto at an angle of approximately 90 degrees to the plane of the cover.

2. The apparatus of claim 1 wherein said pivotably connecting means comprise a hinge attached to the upper end of the missile cell and a peripheral edge of the cover.

3. The apparatus of claim 1 wherein said fixed protuberance is attached to the cover adjacent said hinge and is formed with a cutout shape along its radially innermost edge to provide clearance for the missile during flyout.

4. The apparatus of claim 3 further including spring biasing means mounted between the cover and the top of the cell in the vicinity of said hinge to bias the cover to the fully open position.

5. The apparatus of claim 4 further including releasable latch means having interactive elements mounted respectively on the cover and on the cell for holding the cover closed against the force of the spring biasing means.

6. The apparatus of claim 1 wherein said protuberance comprises a ledge member affixed to the underside of the cover and projecting outwardly therefrom at an angle of approximately 90 degrees relative to the plane of the cover, said ledge member having an area which develops a rotational moment sufficient to overcome the force of said spring biasing means when impinged upon by the exhaust gases from the rocket motor of a missile flying out of the cell.

7. The apparatus of claim 6 wherein the rotational moment developed by the impingement of the rocket exhaust on said ledge member and upon the top of the cover as it rotates away from the open position serve to close the cover and develop a rarefaction wave which is effective in closing said bottom closure.

8. The apparatus of claim 7 further including a ring seal surrounding the opening at the top of said cell for sealing said opening when the cover is in the closed position in order to enhance the rarefaction wave which is developed upon the closing of said cover.

9. The apparatus of claim 8 wherein said missile cell includes adjacent its top opening a reinforcement collar for withstanding the shock force of the sudden closure of said cover.

* * * * *